US006119567A

United States Patent [19]

Schindler et al.

[11] Patent Number: 6,119,567

[45] **Date of Patent: *Sep. 19, 2000**

[54] METHOD AND APPARATUS FOR PRODUCING A SHAPED ARTICLE

[75] Inventors: Melvin S. Schindler, Okemos; John F. Holland, Lansing; Marcos Dantus, Okemos, all of Mich.

[73] Assignee: KTM Industries, Inc., Okemos, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/891,353

[22] Filed: Jul. 10, 1997

[51] Int. Cl.[7] ..... B26D 7/10

[52] U.S. Cl. ..... 83/171; 83/76.8; 83/565

[58] Field of Search ..... 83/171, 76.1, 76.6, 83/76.7, 76.8, 76.9, 565, 701, 956, 170

[56] References Cited

U.S. PATENT DOCUMENTS

| | | | |
|---|---|---|---|
| 2,272,931 | 2/1942 | Boisselier . | |
| 2,743,348 | 4/1956 | Boyajean . | |
| 3,396,616 | 8/1968 | Wright . | |
| 3,555,950 | 1/1971 | Gijsbers . | |
| 3,593,615 | 7/1971 | Shelton | 83/171 X |
| 3,668,956 | 6/1972 | Whipple | 83/565 X |
| 3,715,945 | 2/1973 | Mochizuki et al. | 83/76.6 X |
| 3,902,042 | 8/1975 | Goldfarb et al. . | |
| 4,076,846 | 2/1978 | Nakatsuka et al. . | |
| 4,133,233 | 1/1979 | Pearl | 83/76.6 X |
| 4,391,170 | 7/1983 | Boverman et al. | 83/76.6 X |
| 4,485,295 | 11/1984 | Kellermeyer . | |
| 4,524,894 | 6/1985 | Leblond | 83/565 X |
| 4,539,467 | 9/1985 | Wenger . | |
| 4,601,224 | 7/1986 | Clark, III . | |
| 4,675,825 | 6/1987 | DeMenthon . | |
| 4,736,661 | 4/1988 | Shirai | 83/76.1 |
| 4,863,655 | 9/1989 | Lacourse et al. . | |
| 4,920,495 | 4/1990 | Pilkington | 83/76.7 X |
| 5,035,930 | 7/1991 | Lacourse et al. . | |
| 5,043,196 | 8/1991 | Lacourse et al. . | |
| 5,073,696 | 12/1991 | Patillo et al. . | |
| 5,092,208 | 3/1992 | Rosa-Miranda . | |
| 5,214,590 | 5/1993 | Schnetzer | 83/76.6 X |
| 5,333,111 | 7/1994 | Chaiken et al. | 83/76.6 X |
| 5,397,834 | 3/1995 | Jane et al. . | |
| 5,405,564 | 4/1995 | Stepto . | |
| 5,412,005 | 5/1995 | Bastioli et al. . | |
| 5,438,758 | 8/1995 | Roth-White . | |
| 5,454,287 | 10/1995 | Fuchigami et al. . | |
| 5,459,258 | 10/1995 | Merrill et al. . | |
| 5,462,983 | 10/1995 | Bloembergen et al. . | |
| 5,500,465 | 3/1996 | Krishnan et al. . | |
| 5,506,277 | 4/1996 | Griesbach, III . | |
| 5,523,293 | 6/1996 | Jane et al. . | |
| 5,524,809 | 6/1996 | Kosslow et al. . | |
| 5,538,551 | 7/1996 | Desbiens . | |
| 5,540,929 | 7/1996 | Narayan et al. . | |
| 5,554,660 | 9/1996 | Altieri et al. . | |
| 5,578,691 | 11/1996 | Narayan et al. . | |
| 5,580,911 | 12/1996 | Buchanan et al. . | |
| 5,589,518 | 12/1996 | Bastioli et al. . | |
| 5,616,671 | 4/1997 | Narayan et al. . | |
| 5,727,433 | 3/1998 | Pomerleau et al. | 83/76.9 X |

OTHER PUBLICATIONS

Use and Modification of Biological Substances Chapter 2, pp. 2.1 to 2.2 (1993).

*Primary Examiner*—M. Rachuba
*Assistant Examiner*—T. Anthony Vaughn
*Attorney, Agent, or Firm*—Harness, Dickey & Pierce, P.L.C.

[57] ABSTRACT

A method and preferred apparatus (10) to cut a preform material which is biodegradable and preferably dispersible in water, to produce a shaped article, is described. The cut is produced without producing harmful fumes or leaving a harmful residue and preferably without charring at the cut. Preferably, only small amounts of carbon dioxide and water are produced at the cut. Shaped articles which are in sheet or block form or which are for 2-D or 3-D shaped article formation can be produced.

10 Claims, 8 Drawing Sheets

METHOD AND APPARATUS FOR PRODUCING A SHAPED ARTICLE

BACKGROUND OF THE INVENTION (1) Field of the Invention

The present invention provides a method for shaping a biodegradable, and preferably water dispersible, preform material to produce a shaped article using a heated element in a manner so as not to produce harmful fumes and residues and preferably so as not to char (blacken) the material at the cut. The present invention also relates to particular apparatus for shaping a preform material.

(2) Description of Related Art

The formation of three-dimensional objects from virtual concepts, templates or co-ordinate sets is a widely established and practiced art, existing in many diverse areas. Lathes, mills, and other machine tools use sharp metal cutters acting against metal, wood or plastic materials to create the desired objects. More recently, lasers and high pressure jets of water containing abrasives or plastic resins have extended this art for industrial applications.

Heated elements, including metal wires, blades or points have been used to cut or grove plastic materials and natural materials, such as wood as in wood burning. In addition to manual object control during the forming, applications in this field include computerized control of x, y and x, y, z axes. Many of the plastic materials release toxic fumes; particularly, volatile aromatic compounds. This necessitates operation of these devices in enclosures with sufficient venting. This problem has discouraged the extension of this art to anything other than technical applications requiring skilled users in an industrial environment. In wood burning, the surface of the wood is charred or blackened. Also, wood is not thermoplastic so it is prone to charring. In the present invention, this is not the result.

The patent arts have described the use of various heated elements for cutting preform materials to shape them. U.S. Pat. No. 2,272,931 to Boisselier describes the use of a heated wire incorporated into a hand held device to produce ornaments, figures, designs and the like. The material cut is not specified. U.S. Pat. No. 2,743,348 to Boyajean describes a tool for engraving a thermally decomposable material such as cellulose nitrate. U.S. Pat. No. 3,396,616 to Wright describes an electrically heated lance which is slidably held in place and used to perforate thermoplastic foamed plastics. The foams are not otherwise identified. U.S. Pat. No. 3,555,950 to Gijsbers et al describes the use of a heated wire to cut foils which are composed of a thermoplastic material. U.S. Pat. No. 3,902,042 to Goldfarb et al describes a tool for cutting designs in meltable materials such as styrofoam, which is a thermoplastic material. U.S. Pat. No. 4,485,295 to Kellermeyer describes an electrically heated device for cutting polystyrene or polyethylene foams. U.S. Pat. No. 4,601,224 to Clark, III describes the use of a heated wire to cut a pattern in a polyfoam. The particular material disclosed is polystyrene. U.S. Pat. No. 4,539,467 to Wenger describes the use of a heated cutting tool to cut rubber, plastic and the like. The tool is particularly adapted to cut windshield moldings. U.S. Pat. No. 4,675,825 to DeMenthon describes an automated apparatus for cutting a plastic foam, particularly styrofoam, using heated wire. U.S. Pat. No. 5,073,696 to Patillo et al describes a hand held tool with a heated tip for shaping wax used for models for making jewelry and the like. U.S. Pat. No. 5,092,208 to Rosa-Miranda describes a hot knife which is used to remove flash from molded materials. U.S. Pat. No. 5,438,758 to Roth-White describes a heated knife for cutting foods. U.S. Pat. No. 5,524,809 to Kosslow et al describes a soldering device with a retractable heated tip which could be used for cutting a preform material. U.S. Pat. No. 5,454,287 to Fuchigami et al describes a device for cutting fabrics with a thermal cutter which is indexed into position.

These prior art show that (1) a heated element can be utilized to carve, cut and shape a thermoplastic material by free-hand or by cutting a pattern inscribed on the material; (2) regulation of heat at cutting tip; (3) the use of a vacuum to remove vapors; (4) the use of multiple heated tips; (5) cutting of materials which are non-dispersible in water; (6) cutting of materials (such as polystyrene) which release harmful vapors; and (7) the charring of material such as in wood burning.

A combination of all the embodiments of the prior art results in a cutting tool that when heated can shape thermoplastic material while simultaneously releasing noxious vapors into the air and/or to char the material. The resulting shaped article is generally not easily dispersible in water.

The past ten years have seen the emergence of a new industrial technology termed free form fabrication or rapid prototyping (RP). These methods have been predominantly employed in the field of rapid tool making (RTM) to create tools and dies either directly by printing a binder onto a metal powder, followed by sintering and infiltration, or indirectly by using RP to create a pattern to form the tool by using stereolithography followed by investment casting. In outline RP uses additive processes to create a physical geometry directly from a CAD file. The predominant RP technologies include stereolithography, selective laser sintering, three-dimensional printing, fused deposition modeling, laminated object manufacturing, and the solider process. In the technique of stereolithography, fluid photosensitive resins are solidified by exposure to ultraviolet laser illumination. Selective laser sintering uses the laser-induced fusion of a polymer or polymer-coated powder. Three-dimensional printing uses an ink-jet to print binder onto a powder. Fused deposition modeling involves the extrusion of a thermoplastic material. In laminated object manufacturing, sheets of paper are cut by a laser beam. The solidar technique uses ultraviolet light to cure one layer of photosensitive resin at a time as opposed to other stereolithographic techniques that treat one point in a layer at a time. Alternative strategies presently employed to produce prototype three-dimensional models are ink-jet printing of wax or resin (rather than a binder). A typical instrument to perform these RP approaches with operating software can price from $250,000 to $1,000,000 and requires specialized handling, trained operators, and special environments to isolate the instruments. Photoreactive polymers are expensive and are generally toxic.

In an alternate approach to the rapid production of three-dimensional objects, structures are cut from a building material using a computer controlled milling device. These systems are priced between $50,000 to $100,000 and require specialized handling, skilled operators and must be used in isolated environments because of the production and release of large amounts of modeling material that are generated as fine powder. The production of such waste material can result in serious health hazards for operators.

The general market for all these object forming devices has been the prototype and tool industry. RP annual revenues are approximately $200 million with a growth rate of approximately 30 percent per year.

There are presently no technologies that are commercially available to utilize CAD/CAM tools and provide low cost RP technology and approaches to non-industrial environments. Further, there are presently no building materials available for forming objects that are non-toxic and biodegradable to make possible the introduction of RP methods into the home, school, or office/laboratory environments.

The formation of three-dimensional physical objects employing the previously described approaches to rapid prototyping depends upon the use of photoreactive resins that are exposed to ultraviolet irradiation to solidify defined regions of the material. These polymers are generally expensive, non-biodegradable, and toxic, limiting their use to controlled industrial environments. The need for a UV laser for irradiation is a further limitation on the extension of this technology to home, office or school use.

There is a need for a method for forming shaped articles where the preform material being treated is cut without harmful fumes or leaving harmful residues and preferably without charring, where the preform material and shaped article are biodegradable and preferably where the shaped article is dispersible in water. There is a need for a simpler, more reliable and economical method of providing the shaped article from the preform material.

OBJECTS

It is therefore an object of the present invention to provide a method and apparatus whereby a heated element is used to produce a shaped article from a preform material without generating harmful fumes or leaving harmful residues and preferably without charring. It is a preferred object of the present invention to provide a method and apparatus where the preform material and shaped article can be safely disposed of in the sewer system or in soil because of the biodegradability. It is further an object of the present invention to provide a shaped article which is biodegradable and preferably is water dispersible so that the material can be disposed of in the sanitary sewers, taken to a disposal site or can be recycled. Furthermore, it is an object of the present invention to provide various preferred apparatus which can perform the method. Further still, it is an object of the present invention to provide a method which is easy to perform, reliable and economical and can be safely utilized. These and other objects will become increasingly apparent by reference to the following description and the drawings.

DESCRIPTION OF THE PREFERRED EMBODIMENTS

Figure 1:
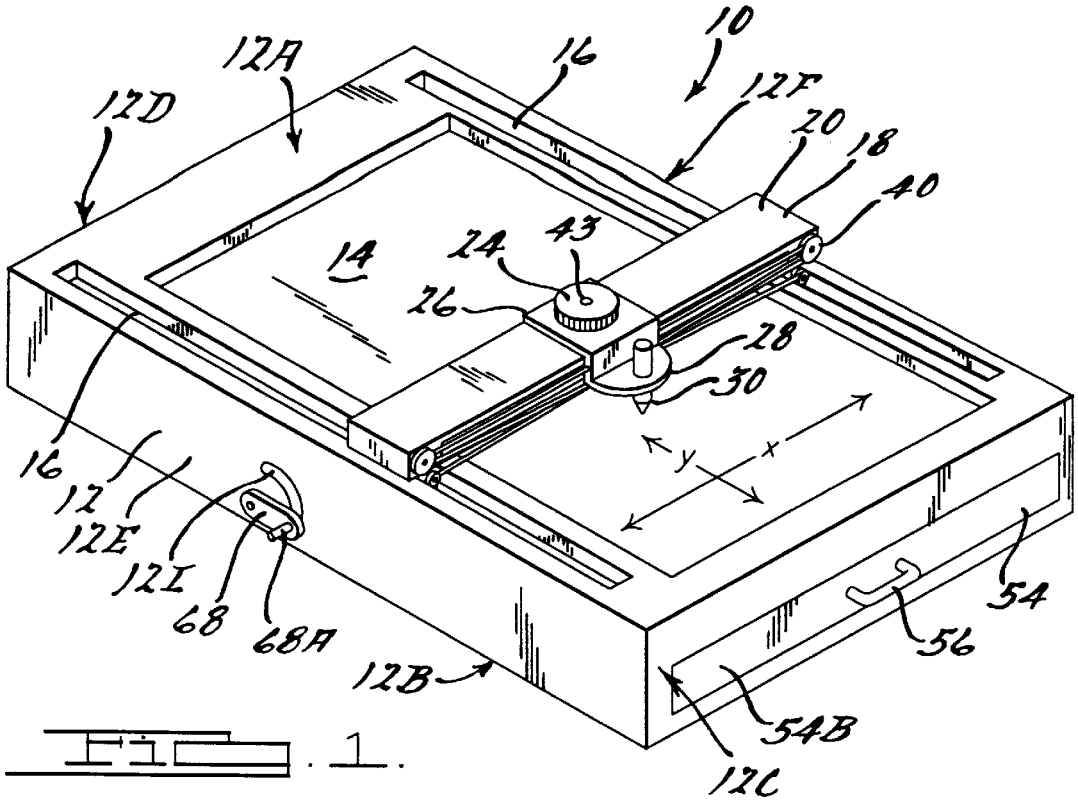
FIG. 1 is a front perspective view of a preferred manually operated drawing apparatus 10 which allows cutting in the x-y direction.

The present invention relates to a method for cutting a preform material to provide a shaped article, the improvement which comprises: providing the preform material as a thermoplastic material which is biodegradable; and contacting the preform material with a heated element to produce the shaped article without producing harmful fumes or leaving a harmful residue on the shaped product and wherein the shaped article and any waste from the cutting is also biodegradable. Preferably, the shaped article does not exhibit charring from the cutting.

Further, the present invention relates to a method for cutting a thermoplastic preform material by means of a heated element to provide a shaped article, the improvement which comprises: providing the preform material comprised of a water dispersible, biodegradable composition which is cuttable by the heated element without producing harmful fumes or leaving a harmful residue when cut by the heated element; and contacting the heated element with the preform material at a temperature which enables the preform material to be cut to provide the shaped article, and without the harmful fumes or the harmful residue on the shaped article, wherein the shaped product and any waste from the cutting is also water dispersible and biodegradable.

Some of the unique features of the present invention are: (1) novel apparatus, structurally and functionally, for engraving, sculpting and cutting preform materials to produce a shaped article which is suitable for the entertainment and education of children; and (2) the use of environmentally friendly, non-harmful, biodegradable thermoplastic compositions, preferably in water dispersible forms. Preferably, the compositions are safe for use in the home and school environment by untrained children and adults. The preferred compositions are safe to use in an unvented environment.

The apparatus regulates the temperature of cutting with the heated element and movement of the heated element for cutting objects in x, y, z or r, θ; movement of the preform material preferably, printing, drawing and painting mechanisms, eg. ink jet are used; and apparatus are provided for regulation of printing, drawing, or painting mechanisms.

The present invention particularly uses compositions which may be edible, non-toxic, biodegradable and are dispersible in water. Firmness and thermal properties can be varied. Non-toxic, biodegradable soybean based inks can be used. Preform materials with altered surface properties for absorbing inks or other imprinting agents or materials can be used. Foams as preform materials with diverse densities for different levels of resolution in the shaped article can be used. Cross-linkable foams which harden with UV irradiation or chemical cross-linking agents can be used. Fixatives or chemical additives can be added to cross-link the foams. Preform materials containing diverse aromas, tastes, adhesives, embedded materials and colors can be used. These agents which produce luminescence, odor or taste are for instance, dyes, extracts, flavors and fragrances.

The polymers used in the present invention are preferably water dispersible. The term "dispersible" means that the polymer is dispersed or disintegrates in water at ambient temperatures 50° F. to 104° F. (10° C. to 40° C.) over time.

The term "charred" as used herein means visibly blackened. There may be a slight brown color in some instances representing carmelization where a polysaccharide is cut with the heated element; however, this is a pleasant smelling result and not visibly unappealing. This excludes cellulose materials, such as paper or wood which is charred when heated and which is not thermoplastic material.

The term "complex design" as applied to the shaped product means that the article has a graphic effect produced by multiple lines of cut.

The heated element can be in the form of a wire, a heated tip or a blade or other heated thermally conductive material as is well known to those skilled in the art. The melting temperature of polyepsilon-caprolactone is 140° F. (60° C). However, the range of various polyesters indicated would be from 140° F. to 248° F. (60° C. to 120° C.). This temperature range would be specified for the starch-polyester blends, as well. The charring or degradation temperature of the polyesters and the starch-polyester blends would be in the range of 428° F. to 572° F. (220° C. to 300° C.). The temperature of the heated element is preferably between 140° F. and 572° F. (60° C. to 120° C.) depending upon the composition of the preform material.

The preform material can be engraved, embossed, stamped or printed prior to cutting with the heated element. It can have different colors and can be luminescent. It can be laminated with another material. The preform material can have an aroma, taste or enhanced recognizability due to the incorporation of luminescent materials, perfumes, fragrances, flavors and the like. The preform material and the resultant shaped product can be a food stuff and can be edible. The shaped article after being cut can be coated with a water resistant material or it can be fixed with a cross-linking agent or chemical or it can be exposed to cross-linking radiation. All of this is well known to those skilled in the art.

The polymers used in the method and apparatus of the present invention are preferably biodegradable and water dispersible. Preferred are the starch polymers. A wide range of other thermoplastic polymers can be used, particularly as binders. Thermoplastic polymers, which can be used but are not preferred, include polyamides, proteins, polyesters, polyethers, polyurethanes, polysiloxanes, phenol-formaldehydes, urea-formaldehydes, melamine-formaldehydes, celluloses, polysulfides, polyacetals, polyethylene oxides, polycaprolactams, polycaprolactones, polyimides, and polyolefins (vinyl-derived thermoplastics). All of these materials are well known and described in the patent art and in the scientific literature. Preferably these materials may be used in small amounts as bundles for biodegradable materials.

The term "biodegradable", as used herein, means that the preform material is essentially reduced to non-toxic compounds in the environment, usually by indigenous microorganisms. The term "essentially" means that a small portion of the preform material (less than 20% by weight) is non-biodegradable. Preferably, the preform materials used in the present invention are virtually completely biodegradable as with the most preferred high amylose starches.

The preferred class of polymers are processed polysaccharides which do not leave a harmful residue; particularly, starch derived polymers which are biodegradable. Other classes of biodegradable polymers includes polyhydroxyalkonates (polyhydroxybutyrate or PHB), polypeptide, protein based polymers and polylactic acids.

The preferred starch based thermoplastic foam results in a shaped product that can either be completely dissolved in water or fixed with a non-toxic chemical agent to become water insoluble. Non-harmful vapors are released (carbon dioxide and water vapor) as a result of the cutting by the heated element into the starch.

The preferred bioplastics are environmentally friendly, non-toxic, rapidly biodegradable and water soluble polymers such as foams, films or more compact compressed structures eg. compression molding for the purpose of using them for molding, drilling, sculpting, filing, carving, shaping and/or cutting these materials into disposable toys, models, puzzles or other solid objects. Waste material can be flushed into the sewer or septic system, taken to a dump site or recycled. The preform materials do not emit toxic fumes when cut with the heated element. The shaped article can be made water-resistant following treatment of their surfaces with hydrophobic materials eg. zein. The preform materials can have different degrees of firmness; and variable thermal responses. Preform materials with altered surface properties for absorbing inks or other imprinting agents or materials can be used. Preform materials with diverse densities and pore sizes for different levels of resolution for drilling, cutting and sculpting can be provided. These materials can be manipulated to have such modified physical properties as thermal stability, color, compressibility, resiliency, hydrophobicity, hydrophilicity, tensile strength and water resistance.

Biodegradable materials are described in U.S. Pat. No. 5,589,518 to Bastioli et al which describes a starchy material or thermoplastic natural polymer bound with a thermoplastic polymer. U.S. Pat. No. 5,405,564 to Stepto et al describes destructurized starches. U.S. Pat. No. 5,580,911 to Buchanan et al describes cellulose esters which are biodegradable. U.S. Pat. No. 5,523,293 to Jane et al describes soybean protein and carbohydrate products which are biodegradable. U.S. Pat. No. 5,462,983 to Bloembergen et al and Narayan et al describe biodegradable caprolactone and starch ester blends. U.S. Pat. No. 5,459,258 to Merrill et al describes polysaccharide based biodegradable thermoplastic resins. U.S. Pat. No. 5,412,005 to Bastioli et al describes starch based polymer composites which are biodegradable. U.S. Pat. No. 5,397,834 to Jane et al describes starch aldehyde and protein based biodegradable polymers. U.S. Pat. No. 4,076,846 to Nakatuska et al describes polymers based upon proteins which are biodegradable. U.S. Pat. No. 5,500,465 to Krishnan and Narayan describe biodegradable starch or polysaccharide and polyester polymer composites. U.S. Pat. Nos. 5,540,929; 5,578,691 and 5,616,671 to Narayan et al describe grafted polysaccharides used to prepare biodegradable preforms. U.S. Pat. No. 5,538,551 to Desbiens describes a composition of starch which is biodegradable. U.S. Pat. No. 5,554,660 to Altieri et al describes an expanded starch product. U.S. Pat. No. 5,506,277 to Griesbach, III describes a resilient foam which is biodegradable.

The most preferred preform material is a form of foamed starch. The U.S. patents describing the foamed starch products are U.S. Pat. Nos. 4,863,655; 5,035,930 and 5,043,196 to Lacourse et al and U.S. Pat. Nos. 5,382,611 and 5,362,777 to Tomka et al. The most preferred preform material is a foamed high amylose starch manufactured by National Starch Corporation and distributed by American Excelsior Company, Arlington, Tex. The foamed products are prepared from a high amylose starch of corn (Hylon VII). The foamed starch is dispersible in water and is biodegradable. In addition, it has the property of decomposing at temperatures between about 250° F. to 470° F. (121.11° C. to 243.33° C.) essentially to carbon dioxide and water without charring in air. The material has the further property of being treatable with a zein solution to inhibit the dissolution of the shaped article. The material is closed cell and has a density of between 0.1 and 5 pounds per square foot.

Starches and their polymers are generally described in "Use and Modification of Biological Substances", Chapter 2, pages 2.1 to 2.2 (1993).

Novel cutting apparatus, directed toward the home and school education and entertainment markets are described hereinafter. Hand operated mechanical and electromechanical devices are described. These can be modular units accommodating a variety of applications and allowing unique combinations of features in a continuous increase in the complexity of the unit and the sophistication of the applications.

This prevents accidental contact of the hot cutting element with the skin or other body parts of the user. The apparatus allows the cutting tools to sculpt the preform material in a manner safe for use by children.

FIGS. 1 to 7 show the first embodiment of the invention in the form of a manually operated drawing apparatus 10 for children. In the preferred embodiment, the article produced by the drawing apparatus 10 is a two-dimensional object constructed from the material 150. The apparatus 10 provides for drawing or tracing concurrent with but functionally distinct from the cutting of the material 150. The apparatus 10 allows for safe cutting of a preform material 150. The apparatus 10 includes a housing 12 having a tracing and cutting arm 18 upon which is mounted the tracing element 30 and the cutting element 39. The housing 12 has a top wall 12A, a bottom wall 12B, a front wall 12C, a back wall 12D and two side walls 12E and 12F forming a rectangular shaped box having an inner chamber 12G. The housing 12 is preferably constructed of a heat resistant thermoplastic. The top wall 12A of the housing 12 is provided with a template area 14 extending essentially the entire length and width of the top wall 12A (FIG. 1). In the preferred embodiment, the template area 14 has a size of 8½"×11", or slightly larger in order to accommodate a standard sheet of paper. The top surface of the top wall 12A is preferably smooth to provide a smooth writing surface. The top wall 12A can be provided with clips (not shown) to secure a template or other writing surface, such as paper, to the top wall 12A. Alternately, the template area 14 of the top wall 12A can be constructed of an erasable material 150 which allows the user to write in the template area 14 and then erase the surface after each use. In the preferred embodiment, the template area 14 is directly above the preform material 150 when the tray 54 is in the fully closed position with the material 150 in the correct position in the inner chamber 12G of the housing 12 (to be discussed in detail hereinafter).

Figure 6:
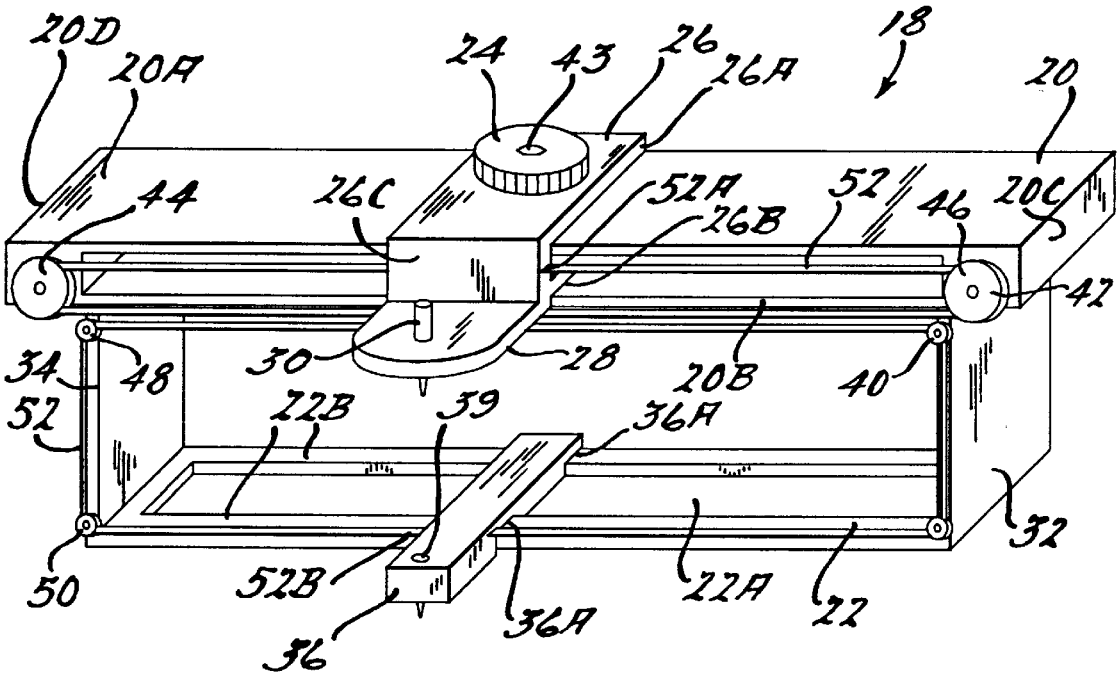
FIG. 6 is a front perspective view of the apparatus 10 showing a tracing element 30, the cutting element 39 and cables and pulleys 52 and 40 and for causing the elements 30 and 39 to move together.

The top wall 12A of the housing 12 has a pair of spaced apart, parallel guide channels 16 extending between the front and back walls 12C and 12D of the housing 12. A tracing and cutting arm 18 is mounted in the guide channels 16 of the housing 12 and is able to slide along the guide channels 16 between the front and back walls 12C and 12D of the housing 12. The arm 18 has an upper tracing portion 20 and a lower cutting portion 22 (FIG. 6). The upper tracing portion 20 preferably has a rectangular shape with a spaced apart, parallel top and bottom walls 20A and 20B with two sidewalls 20C and 20D extending therebetween. The arm 18 is mounted on the housing 12 such that the tracing portion 20 is spaced above the top wall 12A of the housing 12 and the cutting portion 22 is spaced below the top wall 12A of the housing 12 in the inner chamber 12G of the housing 12. The upper tracing portion 20 has a length such as to span completely between and slightly beyond the guide channels 16 on each side on the top wall 12A of the housing 12. A controller 24 is slidably mounted on the upper tracing portion 20 of the tracing and cutting arm 18. The controller 24 has a bracket 26 and a tracing element holder 28. The bracket 26 has a rectangular shape with spaced apart upper and lower legs 26A and 26B which are connected together at the ends by a front and rear wall 26C and (not shown). The controller 24 is mounted on the upper portion 20 of the arm 18 such that the upper leg 26A of the bracket 26 extends above the top wall 20A and the lower leg 26B extends between the top and bottom walls 20A and 20B of the upper portion 20. The tracing element holder 28 preferably is mounted on the front wall 26C of the bracket 26 and extends outward in a direction opposite the bracket legs 26A and 26B. The tracing element holder 28 has an opening (not shown) within which is mounted the tracing element 30. Preferably, the front wall 26C of the bracket 26 is slightly greater in length than the distance between the legs 26A and 26B of the bracket 26 such that the tracing element holder 28 is slightly lower than the bottom leg 26B of the bracket 26 such that when the controller 24 is mounted on the arm 18, the tracing element holder 28 is aligned with the bottom wall 20B of the upper portion 20. Preferably, the position of the controller 24 is adjustable to vary the height of the tracing element holder 28 to accommodate different types of tracing elements 30. The tracing element 30 can be moved in both the x and y directions and is used to write or trace in the template area 14. For freestyle drawing, a pencil or pen can be used as the tracing element 30 and for tracing, a solid non-marking tip can be used.

The tracing portion 20 of the arm 18 is connected to the lower cutting portion 22 of the arm 18 by a pair of connecting sidewalls 32 and 34. The sidewalls 32 and 34 are mounted to the bottom wall 20B of the tracing portion 20 such that when the arm 18 is correctly mounted adjacent the top wall 12A of the housing 12, the connecting sidewalls 32 and 34 extend downward through the guide channels 16 and into the inner chamber 12G of the housing 12.

The cutting portion 22 preferably extends between the connecting sidewalls 32 and 34 and has a cutting element holder 36 slidably mounted thereon. In the preferred embodiment, the cutting portion 22 has a rectangular opening 22A in the middle such as to form rails 22B extending between the connecting sidewalls 32 and 34. The cutting element holder 36 preferably has a rectangular shape with two channels 36A adjacent one end on the bottom surface of the holder 36. The cutting element holder 36 is mounted on the cutting portion 22 such that the rails 22B of the cutting portion 22 are mounted in the channels 36A of the cutting element holder 36. The opposite end of the cutting element holder 36 is provided with an opening (not shown) within which is mounted the cutting element 39. In the preferred embodiment, the cutting element 39 is a heated wire. However, the cutting element 39 can be of a variety of types such as a cutting blade or vibrating blade. The cutting element 39 is within the housing 12 at all times and is not exposed to the user.

In the preferred embodiment, the sliding controller 24 with the tracing element holder 28 is connected to the cutting element holder 36 such that the cutting element holder 36 moves in direct correspondence and simultaneously with the controller 24 and the tracing element holder 28. The arm 18 is provided with a pulley system 40 which allows the tracing element 30 to move across the width of the template area 14 of the housing 12 in the x direction and the cutting element 36 to move across the width of the material 150 in the x direction as the controller 24 is moved across the width of the arm 18. The pulley system 40 preferably includes a right half 42 and a left half 44. The halves 42 and 44 of the pulley system 40 are preferably mirror images and therefore, only the right half 42 of the system 40 will be described in detail. The right half 42 of the pulley system 40 has an upper pulley wheel 46 and two lower pulley wheels 48 and 50. The upper pulley wheel 46 is preferably mounted adjacent one end of the upper portion of the arm 18 on the side adjacent the tracing element holder 28. The lower pulley wheels 48 and 50 are preferably mounted along one side of the connecting side wall 34 adjacent the opposite end of the arm 18. The first lower pulley wheel 48 is preferably mounted at the top of the sidewall 34 adjacent the guide channel 16 of the housing 12. The second lower pulley wheel 50 is preferably mounted at the bottom of the sidewall 34 at the point where the lower cutting portion 22 is connected to the sidewall 34. A cable 52 is preferably connected at one end 52A to one side of the tracing element holder 28 of the controller 24. The cable 52 extends around the first pulley wheel 46 and back towards and beneath the tracing element holder 28 of the controller 24 and then down through the adjacent guide channel 16 and around the first lower wheel 48 and straight down around the second lower wheel 50 and then along one rail 22B of the cutting portion 22 and is connected to the cutting element holder 36. In the preferred embodiment, the direction of the cable 52 is changed 180° around the upper pulley wheel 46 and is changed 90° around each of the lower pulley wheels 48 and 50. The left pulley system 44 is similarly but oppositely connected. In the preferred embodiment, the right half 42 of the pulley system 40 allows the tracing element holder 28 and the cutting element holder 36 to move simultaneously toward the left side of the template area 14. Similarly the left half 44 of the pulley system 40 allows the tracing element holder 28 and the cutting element holder 36 to move simultaneously toward the right side of the template area 14. The pulley system 40 enables the cutting element holder 36 to move in direct response to movement of the controller 24 to provide an identical image or cut on the material 150. In the preferred embodiment, the pulley cables 52 are constructed of nylon. Alternately, the pulley cables 52 can be a toothed belt and the pulley wheels 46, 48 and 50 can be provided with corresponding teeth to provide better traction as the controller 24 is moved.

In an alternate embodiment (not shown), a single loop pulley system can be used to provide a mirror image on the material 150 as the tracing element 30 is moved along the template area 14. In the single loop pulley system, only the lower pulley wheels 48 and 50 are used. The right pulley cable 42 is mounted at one end to the tracing element holder 28 and extends outward toward the adjacent guide channel 16. The cable 52 extends down into the channel 16 and around the lower pulley wheels 48 and 50 and is then connected to the cutting element holder 36. The left pulley cable is similarly but oppositely connected. The single loop pulley system allows for the cutting element holder 36 to move in the opposite direction across the width of the housing 12 as the controller 24 is moved.

Figure 5:
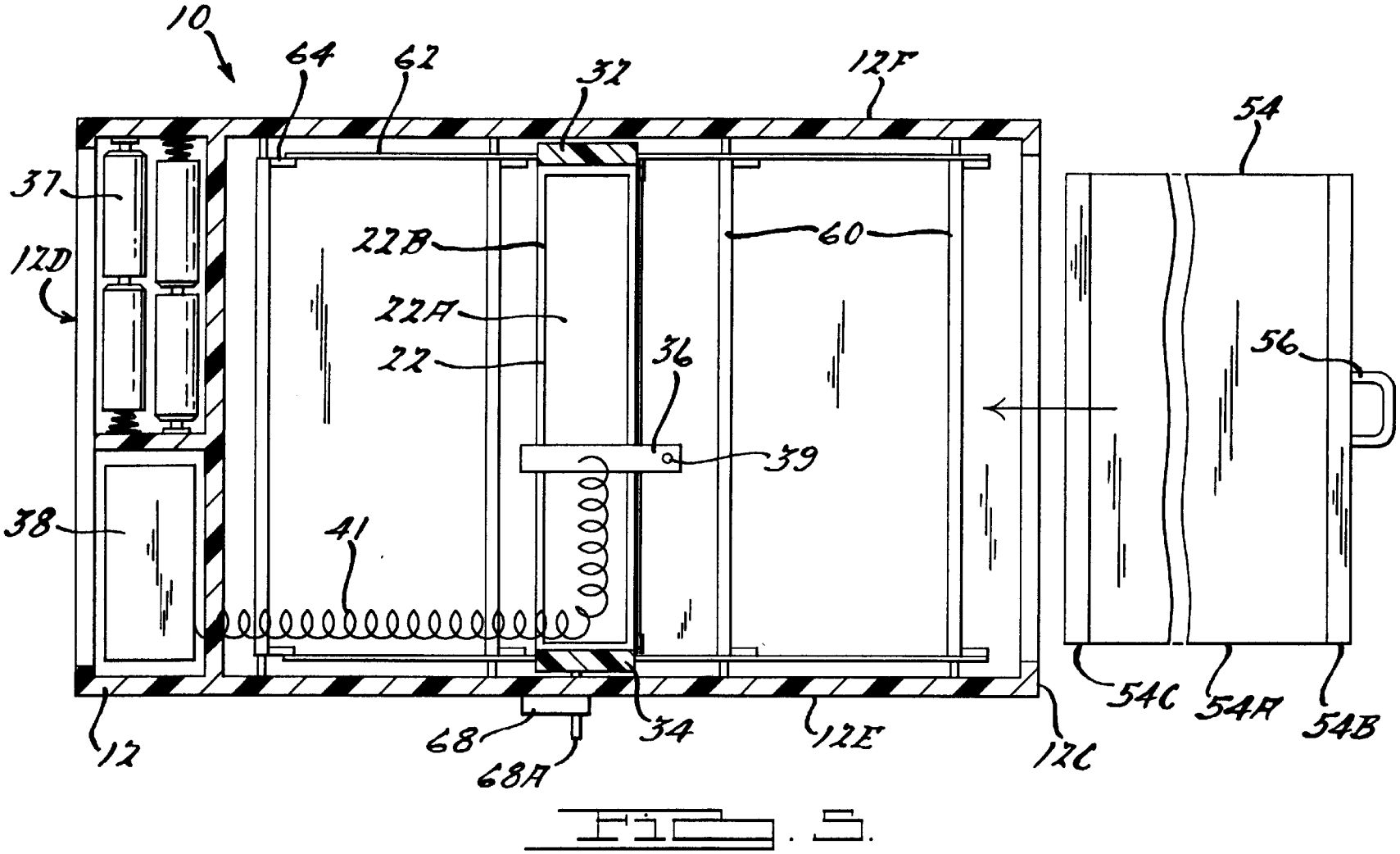
FIG. 5 is a cross-sectioned plan view of the apparatus 10 showing the heated element 39.

In the preferred embodiment, the cutting element 39 is a heated wire 118. The power source 37 and electrical control circuit 38 for the heated wire 118 are preferably provided at one end of the housing 12 opposite the tray opening (FIG. 5). The power source 37 preferably includes four double AA batteries. Alternatively, the apparatus 10 can be plugged in and a step down transformer (not shown) can be used to provide the correct power and current. In addition, the power source 37 can be rechargeable batteries which can be recharged by plugging in the apparatus 10. The circuitry for allowing the apparatus 10 to be plugged in is well known in the art as is the circuitry for recharging the batteries. The control circuit 38 preferably includes a means for regulating the current from the power source 37 such that a constant current is provided to the cutting element 39 and the cutting element 39 is at a constant temperature. The current regulator could be in the form of a microchip. The power source 37 and control circuit 38 are preferably connected to the cutting element 39 by a flexible, electrical ribbon 41 which allows the arm 18 to move without breaking the electrical connection (FIG. 5). In the preferred embodiment, the cutting element 39 is a nichrome wire. The amount of current provided to the cutting element 39 will depend upon the type of heating element used in the cutting element 39. In addition, the temperature of the cutting element 39 can be varied depending on the type of material 150 to be cut. In the preferred embodiment, the temperature of the cutting element 39 is preferably between 250° F. and 470° F. (121.11° C. and 243.33° C.).

The apparatus 10 is preferably provided with an on/off switch 43 which activates the cutting element 39. In the preferred embodiment, the on/off switch 43 is located in the controller 24 such that when the tracing element 30 is moved into position and is in contact with the template surface 14, the switch 43 is turned "on" and the heated cutting element 39 is activated. In the preferred embodiment, the heated cutting element 39 is constructed such that the element 39 is instantaneously the correct cutting heat when the element 39 is activated. Alternately, the apparatus 10 has a delay switch (not shown) which prevents the user from moving the controller unit 24 before the cutting element 39 is at the correct temperature. The on/off switch 43 can also be located in the side walls 12D and 12E of the housing 12, separate from the controller 24. In that embodiment (not shown), the on/off switch 43 would need to be turned "on" prior to movement of the controller 24. This embodiment would also preferably include an automatic "off" feature which would deactivate the heating element 39 if the controller 24 was stationary for a set period of time.

Figure 4:
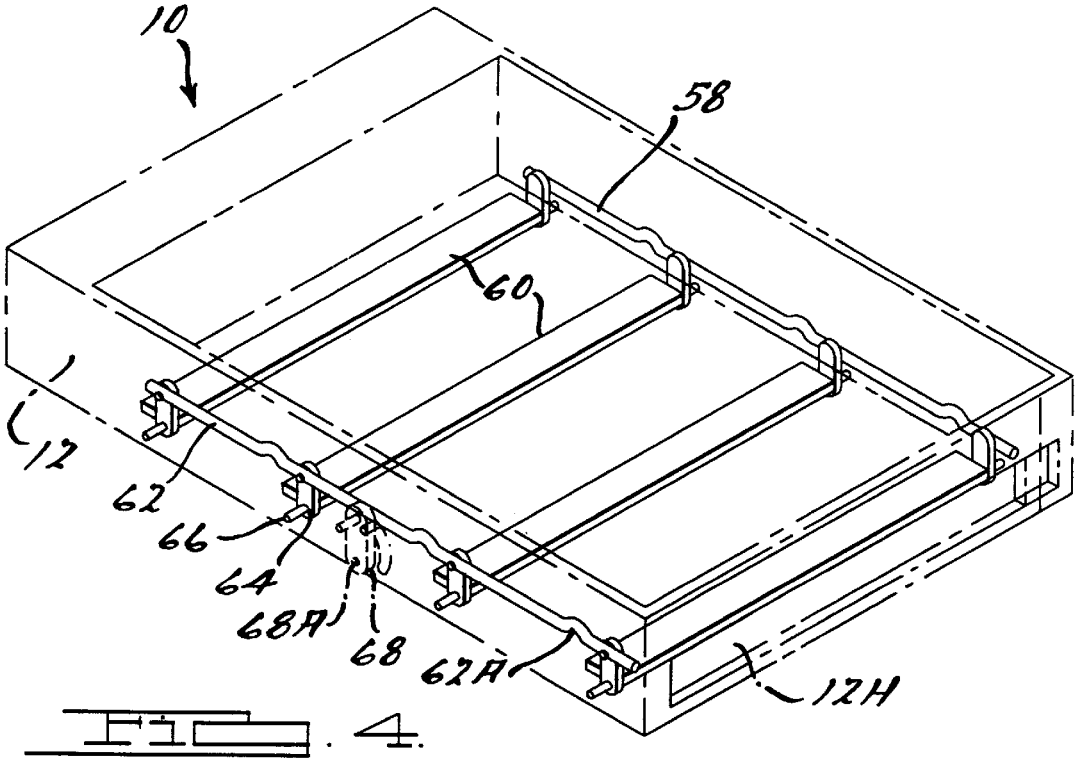
FIG. 4 is a front perspective view of the apparatus 10 with the housing 12 shown in broken lines showing the elevator linkages 64 in the elevated position of FIG. 2.
Figure 2:
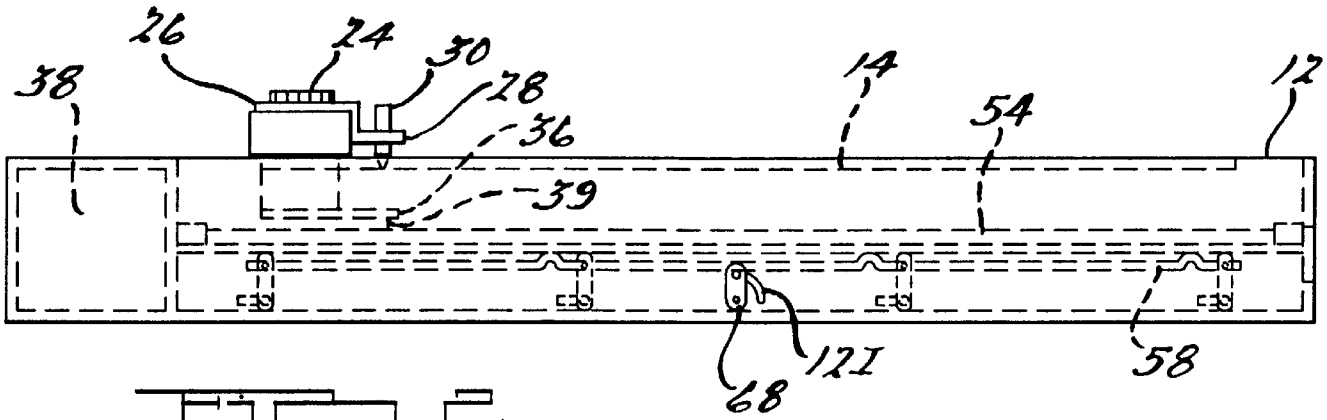
FIG. 2 is a left side view of the apparatus 10 showing a tray 54 in dotted lines in an elevated position for cutting by the cutting element 39.
Figure 3:
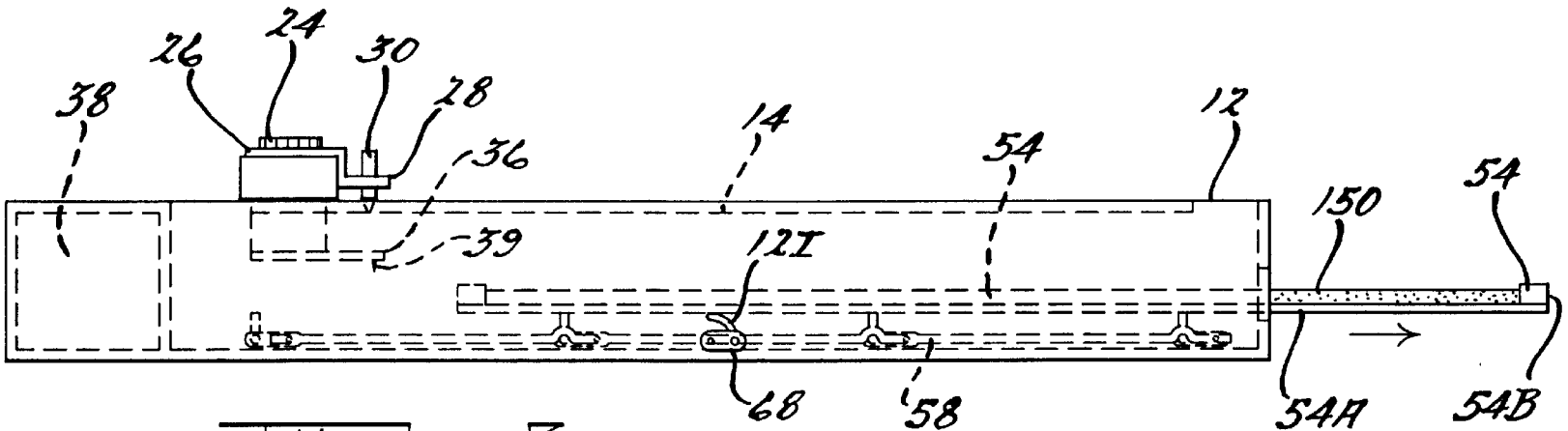
FIG. 3 is a left side view showing the tray 54 in a lowered position away from the cutting element 39 for removal of the tray 54 and insertion of a preform material 150 into the apparatus 10.
Figure 7:
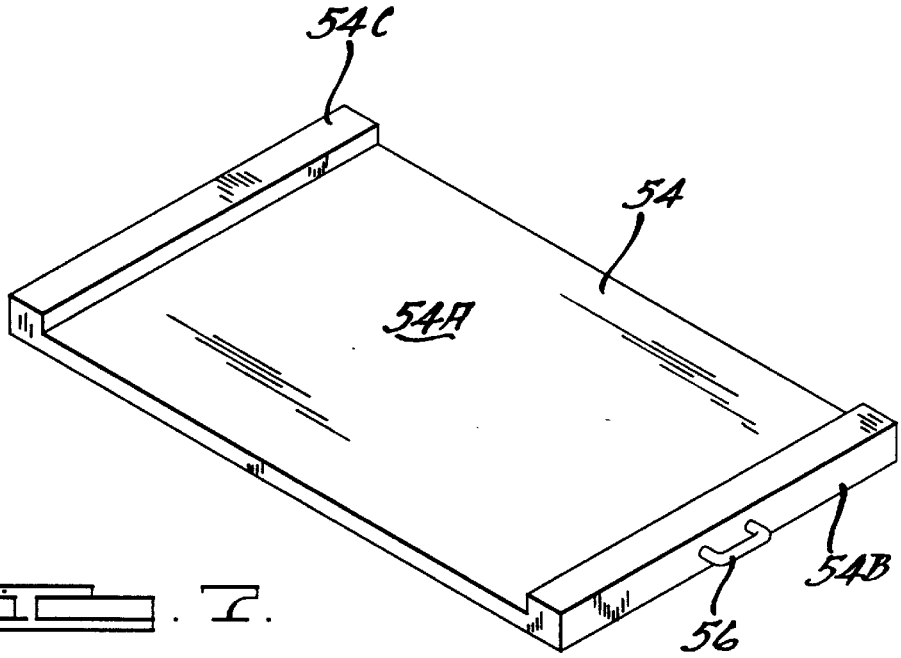
FIG. 7 is a front perspective view of the tray 54 for supporting the preform material 150 during the cutting.

The front wall 12C of the housing 12 has an opening 12H within which is mounted a slidable material tray 54 or drawer. The material tray 54 includes a support surface or floor 54A and a front and rear plate 54B and 54C (FIG. 7). The front plate 54B has a handle 56 on the side of the plate 54B opposite the floor 54A. When the tray 54 is fully within the housing 12 in the closed position, the front plate 54B is preferably flush with the front wall 12C of the housing 12 such that only the handle 56 extends outward (FIG. 1). The tray 54 allows for easy insertion and removal of the material 150 from the housing 12. In an alternate embodiment (not shown), the tray or drawing 54 can be inserted through an opening in one of the sidewalls 12E or 12F of the housing 12. In an alternate embodiment (not shown), the top wall 12A of the housing 12 has a closable opening which allows for easy insertion of the preform material 150 into the housing 12 and removal of the article from the housing 12 after cutting. In the preferred embodiment, a safety switch (not shown) is provided between the housing 12 and the tray 54 such that the tray 54 must be in the fully closed position to activate the cutting element 39. The housing 12 also includes an elevating mechanism 58 which elevates the tray 54 along with the material 150 to place the material 150 in a position for cutting by the cutting element 39 (FIGS. 2 to 4). The elevating mechanism 58 includes a series of parallel, spaced apart elevators 60 which are connected together along each end by a pair of elevating rods 62. The elevating rods 62 are connected to the elevators 60 by linkages 64 which are pivotably connected to the elevating rods 62 at one end and pivotably connected to the elevators 60 at the other end. The linkages 64 are provided with a stopper pin 66 at one end which contacts an indentation 62A in the elevating rod 62 and prevents the linkage 64 from rotating beyond the maximum elevation. A switch or lever 68 is preferably provided on one of the elevating rods 62 of the elevating mechanism 58 (FIG. 1). The handle 68A of the switch 68 preferably extends out an arcuate opening 12I in one of the side walls 12E or 12F of the housing 12 and enables a user to move the material 150 into or out of the cutting position (FIGS. 2 and 3). In an alternate embodiment, the elevating mechanism 58 is automatic such that when the cutting element 39 is activated, the elevating mechanism 58 automatically moves the material 150 into the cutting position. To use the apparatus 10 of the preferred embodiment, the material 150 is placed on the floor 54A of the tray 54 and the tray 54 is moved into the fully closed position (FIG. 1). In the fully closed position, the material 150 is directly below the template area 14. The elevating mechanism 58 is then elevated to move the tray 54 and material 150 into the cutting position. The on/off switch 43 on the controller 24 is pressed to activate the control circuit 38 to heat the cutting element 39. Preferably, the switch 43 must be continuously pressed to keep the cutting element 39 hot. In the preferred embodiment, the cutting element 39 is instantaneously the correct cutting temperature. Next, the controller 24 is moved to move the tracing element 30 to draw or trace the desired object. Once the object is completely drawn or traced by the tracing element 30, the tray 54 is lowered and opened and the cut material 150 is removed. Preferably, the cut material 150 is in the form of the object being drawn or traced.

In operation, the preferred embodiment of the apparatus 10 is used manually in modes similar to writing other x, y coordinate systems. Depending on the size and length of the cutting element 39 and the amount of interdiction into the material 150, either engraving or cutting can be accomplished with relative ease. Cutting elements of different dimensions and heating capacity can be readily interchanged, bringing a wide versatility to the apparatus 10. Although a heated cutting element 39 is preferred, the cutting element 39, the depth of the preform material 150 could also be in the form of a knife or vibrating blade. As the tracing element 30 is moved along the template area 14, the cutting element 39 simultaneously moves along the material 150. The cutting element 39 will engrave or cut the material 150 to form the object being traced or drawn. The depth of cut or engraving is preferably manually adjustable prior to cutting. Once cutting is complete, the cutting element 39 is deactivated. The tray 54 is then opened to remove the object and the cutaway material 150.

In one use of the drawing apparatus 10, the material 150 is provided with a picture or drawing on the top surface. In the preferred embodiment, the surface material 150 is able to be printed on using an ink jet printer. The material 150 is placed in the tray 54 and in the apparatus 10. A jigsaw puzzle template (not shown) is placed on the template area 14 and is traced using the tracing element 30. The material 150 is cut in direct response to the movement of the tracing element 30. The resulting object is a jigsaw puzzle having a specific picture.

In an alternative embodiment (not shown), the material 150 and tray 54 are not elevated into the cutting position rather the entire arm 18 is spring loaded such that when the user pushes down on the controller 24, the entire arm 18 moves downward such that when the tracing element 30 makes contact with the template area 14, the cutting element 39 makes contact with the material 150. The downward movement also activates the heating element when the cutting element 39 uses heat. When the controller 24 is released, the arm 18 moves back into its disengaged position and the heating element 39 is deactivated. When the tracing element 30 is depressed to make contact with the template or paper, it likewise depresses the internally mounted heating element 39 into the material 150 to a comparable depth of penetration and activates the cutting element 39. The cutting element 39 will engrave or cut the material 150 to the form of the object being drawn or traced. Upon release of the tracing element 30, the cutting element 39 is removed from the material 150 and heating and cutting is halted. The tray 54 can now be opened to remove the cut material 150. The depth of penetration is preferably set by the dimensions of the cutting element 39 and adjustments of the extent of motion coupled to the mechanical displacement produced by the activation action.

In another embodiment, a push button on the upper portion of the arm is pushed down by the user which in turn pushes down the cutting element 39 which activates the cutting element 39 to heat the cutting element 39.

In an alternate embodiment (not shown), the apparatus is automatically controlled by a computer. The controller is automatically moved in response to an output from the computer. Small motors are used to drive the controller along the x and y axes preferably under the control of a joystick. The cutting element is activated by a pressure switch on the joystick which maintains the same degree of safety as the apparatus 10 of the preferred embodiment. The penetration of the cutting element is accomplished by a solenoid action activated by a switch on the joystick. Alternatively, digital ROM chips are used to drive the motors in lieu of joystick control. Each chip can contain information for a single or multiple designs to be engraved or cut in the material 150. Preferably, the chips are easily replaceable and also replace the need for a template. A z axis control can be added by means of a mechanical drive capable of positioning the cutting element along a vertical axis. When this feature is present, the chips can now control the z axis as well as x and y axes. For more precise actions along the x and y axes, the small DC motors can be replaced with stepper motors, which will increase the cost, performance and versatility of the apparatus.

From the electro mechanical embodiment to one of direct computer control requires an interface to the apparatus and software to control the operations. Predetermined software for creating the various designs, is used as well as graphics programs whereby unique designs are developed with the computer and transferred to the apparatus for creating the two and three dimensional objects. The apparatus can also be provided with angular coordinate motions to increase the range and resolution on the x, y and z axes which greatly expands the capacity and performance of the apparatus. The complex apparatus will be an automated 3-D lithograph. The computer which controls the apparatus can be connected to a network or the Internet which allows the operation of a three-dimensional facsimile machine whereby designs from one site can be transferred to a remote site resulting in actual physical objects being created under the dictates of the information being transferred.

Figure 8:
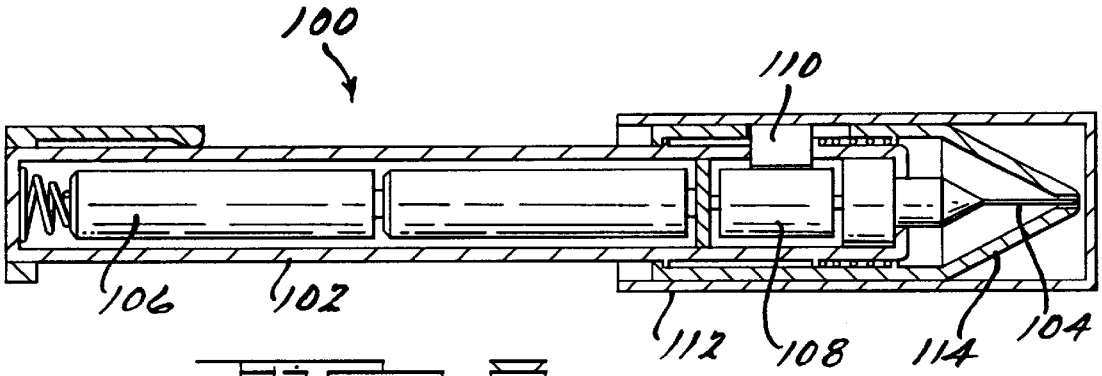
FIG. 8 is a front cross-sectioned view of a tool 100 with a cutting tip 104 for cutting a preform material 150.
Figure 9:
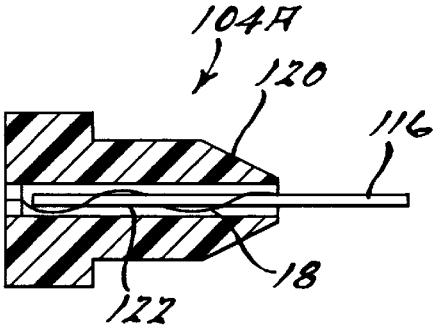
FIGS. 9 to 11 are front cross-sectioned views of various types heated cutting tips 104A, 104B and 104C.

FIGS. 8 to 12 show another embodiment of the invention in the form of a sculpting or cutting tool 100 for cutting the material 150. The tool 100 preferably cuts and sculpts the material 150 using a heated cutting tip 104. The tool 100 has an elongate body 102 with the sculpting or cutting tip 104 at one end. The tool 100 is preferably similar in shape to a fountain pen. The body 102 of the tool 100 preferably has a cylindrical shape and includes a power source 106 and a control circuit 108 (FIG. 8). In the preferred embodiment, the power source 106 is two AA batteries which produces sufficient current. An "on/off" side switch 110 is preferably provided on the side of the body 102 of the tool 100 and must be continually depressed in order to keep the tip 104 hot. When the tool 100 is not in use, the tip 104 of the tool 100 is preferably covered by a cap 112, similar to the cap of a pen. Once the cap 112 is removed, the cap 112 is placed on the opposite end of the tool 100 which causes a safety switch (not shown) in the tool 100 to be disabled and thus, allow the cutting tip 104 of the tool 100 to be activated. In the preferred embodiment, the tool 100 can not be activated unless the cap 112 is placed over the end of the tool 100. In addition, the "on/off" side switch 110 must be depressed to activate the cutting tip 104. In the preferred embodiment, the cutting tip 104 rapidly heats and cools which allows virtually instant control of the cutting tip 104 using the side switch 110. A safety shield 114 is also provided over the tip 104 of the tool 100. The safety shield 114 is spring biased completely over the tip 104 when the tool 100 is not in use. When in use, an upward force on the safety shield 114 moves the shield 114 upward and exposes the tip 104. As the user continues to press down, the shield 114 continues to move upward. The safety shield 114 can also be used to control the depth of cut of the cutting tip 104 by exposing only a set amount of the tip 104. The safety shield 114 can be preset to only slide a set distance or in an alternate embodiment, the user can prevent further upward movement of the shield 114 by using a finger to block the upward movement of the shield 114. The cutting tip 104 is preferably in the form of a resistively heated wire or probe. In one embodiment, the cutting tip 104A is a solid metal rod 116 which is wrapped at one end with a nichrome wire 118 which is the heat source (FIG. 9). Preferably, the nichrome wire 118 is within the housing 120 at the tip 104A of the tool 100. The nichrome wire 118 is preferably surrounded by insulating material 122 which prevents the nichrome wire 118 from melting the housing 120 and which keeps the heat from the nichrome wire 118 directed toward the metal rod 116. Different wire or probe dimensions accommodate different engraving, sculpting and cutting applications.

Figure 10:
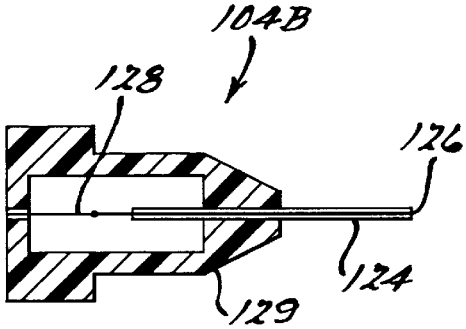

In another embodiment, the cutting tip 104B includes an insulated hypodermic needle 124 within which is mounted a nichrome wire 126 (FIG. 10). The needle 124 is preferably similar to those used for gas chromatography. The nichrome wire 126 is preferably connected to the power source 106 and control circuit 108 by a copper connector wire 128 located within the housing 129 for the tip 104B.

Figure 11:
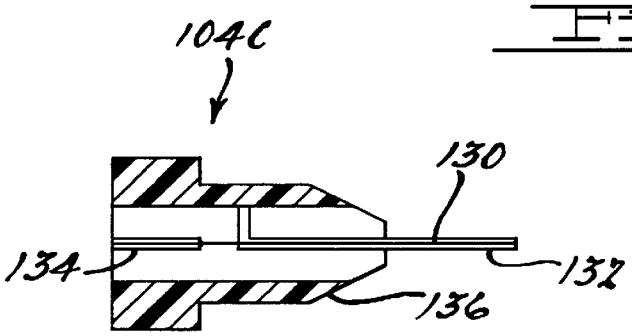
Figure 12:
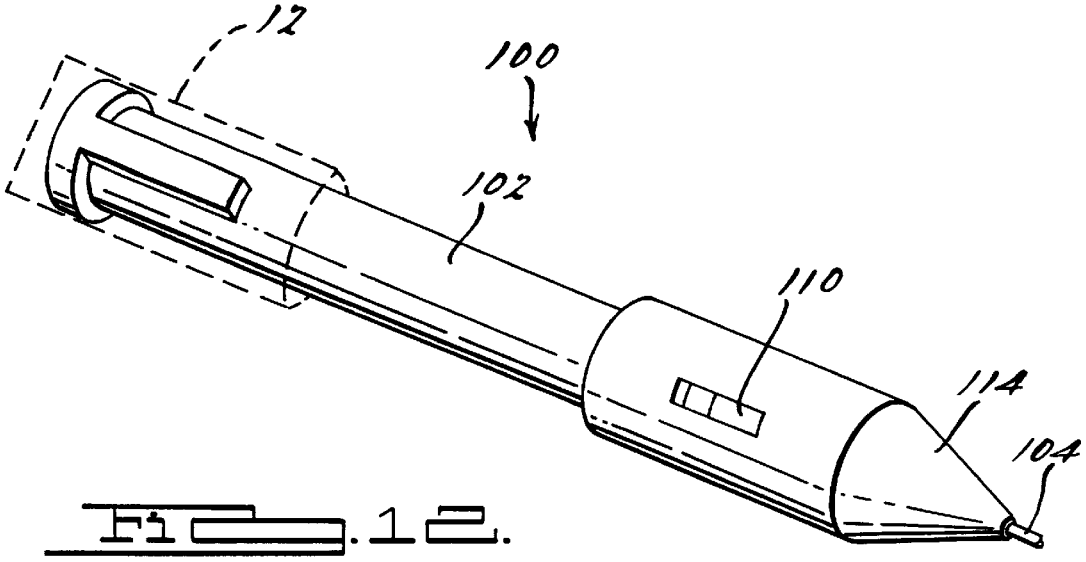
FIG. 12 is a perspective view of the pen 100 showing the cutting tip 104.

In another embodiment, the cutting tip 104C is constructed of a single nichrome wire 130 (FIG. 11). The nichrome wire 130 preferably has a covering 132 on the outer surface to prevent oxidation of the wire. The nichrome wire 130 is preferably connected by a copper connector wire 128 to the power source 106 and control circuit 108 in the housing 136 for the tip 104C.

In all embodiments, the housing 120 adjacent to the tip 104 of the tool 100 is preferably constructed of a heat resistant thermoplastic such as to prevent the heated cutting tip 104 from melting the housing 120. Also, preferably the housing 120 for the tip 104 of the tool 100 is constructed of a material 150 which is not heat conductive and will remain cool.

Figure 17:
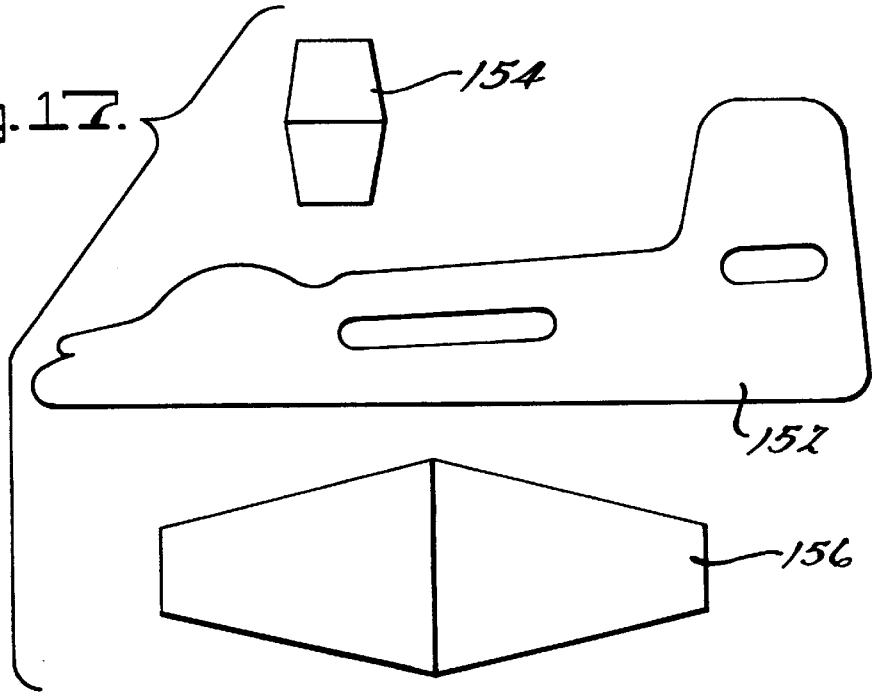
FIG. 17 is a top view showing the pattern cutouts used for forming a toy airplane.

In an Example using the tool 100, components for a model airplane (not shown), including a body 102, an elevator 154 and wings 156, were cut from the preferred biodegradable, water dispersible foam panel or sheet using a heated blade temperature of 250° F. to 470° F. (121.11° C. to 243.33° C.) (FIG. 17). An outline of each component was drawn with ink on the panel and the heated blade was used to smoothly cut along the outline to form the appropriate pieces. The pieces were assembled into a three-dimensional model of an airplane that was flown. When placed in water with mild agitation, the airplane dispersed into a colloidal suspension.

Figure 13:
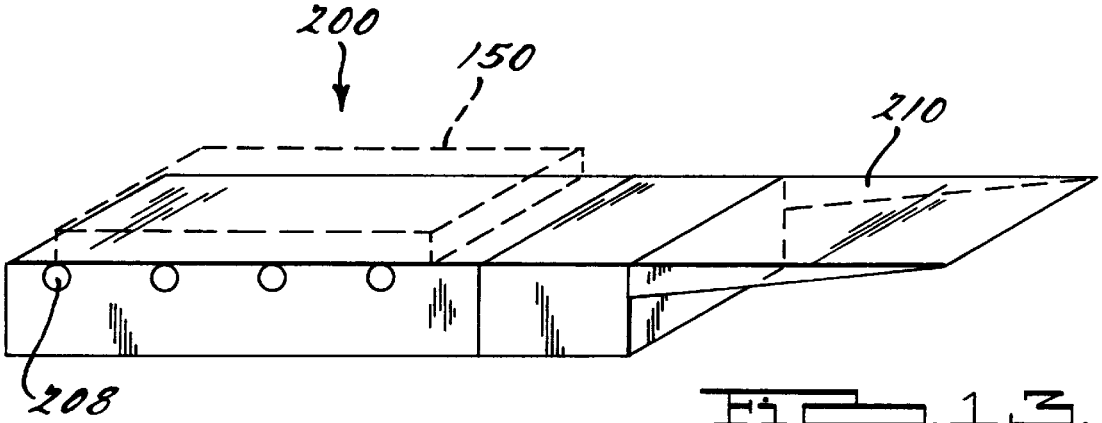
FIG. 13 is a side perspective schematic view of the cutting apparatus 200.
Figure 14:
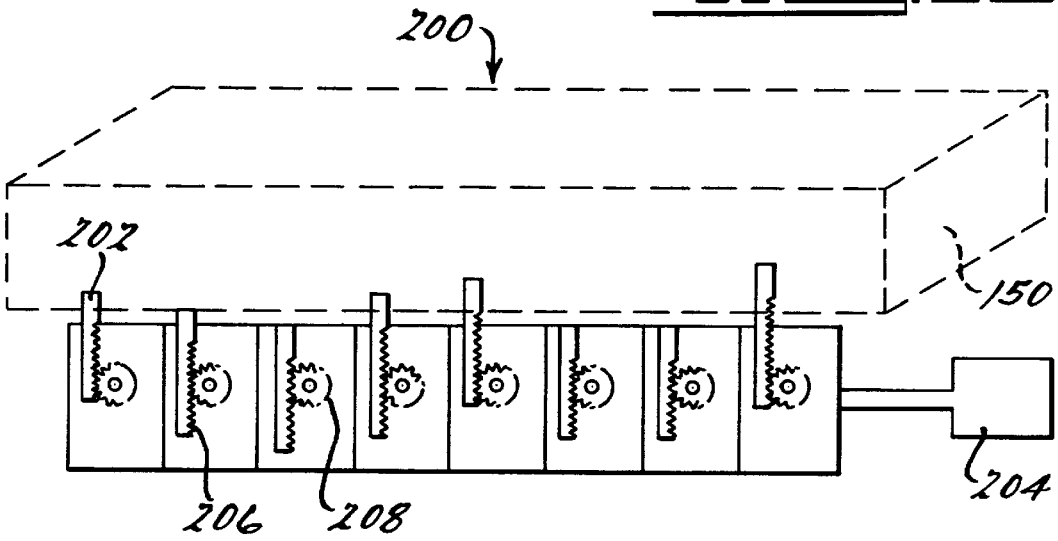
FIG. 14 is a schematic view of a cutting apparatus 200 showing the cutting elements 202 and the controller 204.

In an alternate embodiment, an apparatus 200 is used to create different shapes including two and three dimensional objects out of the material 150. FIGS. 13 and 14 show an automated apparatus 200 for producing different images in a sheet or block of material 150. The apparatus 200 includes a series of cutting elements 202 which are controlled by a controller 204 such as a computer. The cutting elements 202 are moved up and down depending on the desired depth of cut. The depth of the cutting elements 202 can also be adjusted to completely cut through the sheet of material 150 or can be adjusted to not cut the material 150 at all. The apparatus 200 allows for multiple areas of cutting across the sheet or block of material 150 during one pass of the sheet or block through the apparatus 200. The cutting elements 202 are preferably heated wires similar to those described for use in the drawing apparatus 10 or the cutting tool 100. Alternatively, the cutting elements 202 are blades which saw or cut the material 150 in response to up and down motion. In the preferred embodiment, the cutting elements 202 are provided with racks 206 which move up and down in response to the rotation of pinions 208 which are controlled by the controller 204. The cutting elements 202 could also be moved using a variety of well known means. The apparatus 200 preferably has a conveyor 210 which moves the sheet or block of material 150 into contact with the cutting elements 202. The cutting elements 202 are preferably positioned below the sheet or block of material 150 such as to cut into a top or bottom surface of the sheet or block of material 150. The depth of cut of the cutting elements 202 is controlled by the controller 204. The cutting elements 202 can cut completely through the material 150 or can be used to engrave the material 150.

Figure 15:
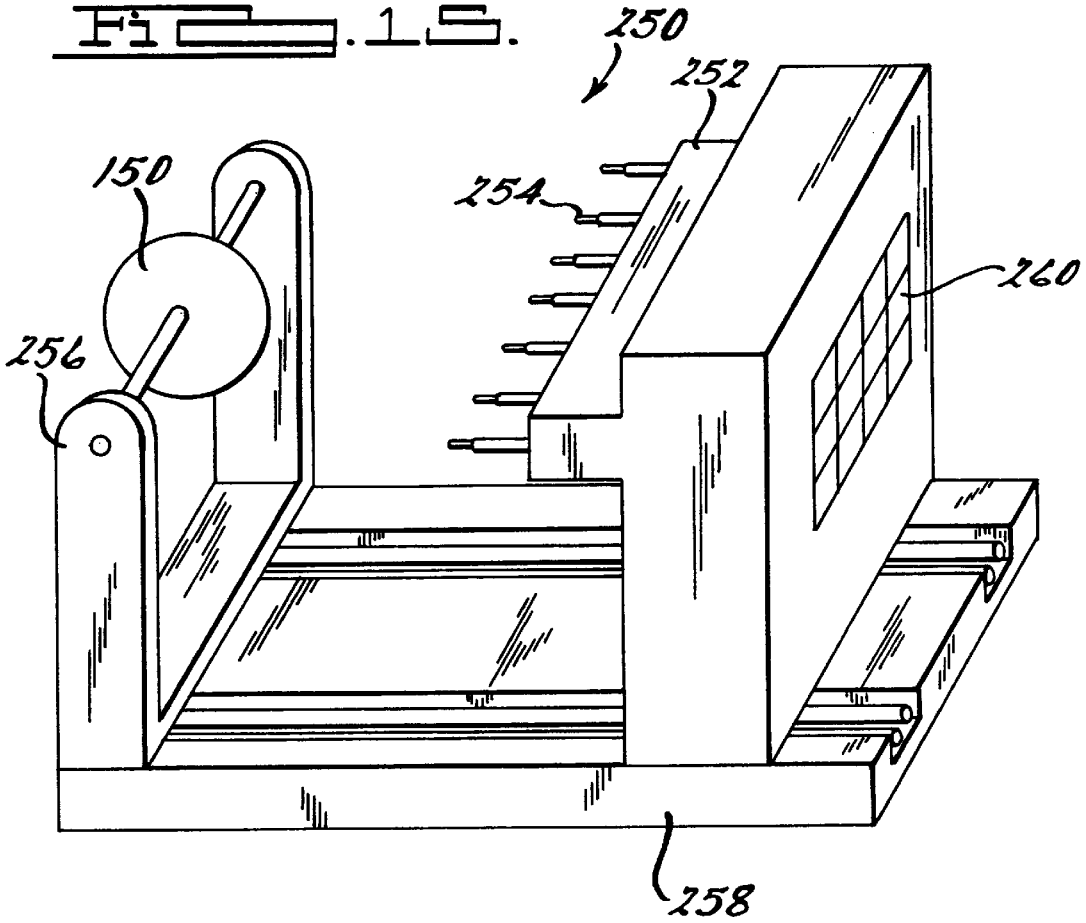
FIG. 15 is a perspective schematic view of a third forming apparatus 250 showing the cutting elements 254 and the preform material 150.

In another alternate embodiment, a three-dimensional object (not shown) is formed using an apparatus 250, a computer controlled cutting unit 252 having a series of cutting elements 254 (FIG. 15). The apparatus 250 creates the three-dimensional object by selectively heating and vaporizing specific regions of a solid three-dimensional material 150. The apparatus 250 includes a mounting bracket 256 for holding the material 150 and a cutting unit 252 having a series of cutting elements 254. The apparatus 250 is enclosed in a forming chamber (not shown) which prevents access to the apparatus 250 when the apparatus 250 is in operation. In the preferred embodiment, the material 150 is rotatably mounted on the mounting bracket 256 on one end of a plate 258. Preferably, micro-positioners (not shown) are provided in the apparatus 250 to position the cutting unit 252 and the material 150. The rotation of the material 150 is controlled by the controller 260 which also controls the cutting unit 252. The controller 260 is preferably a computer. The cutting unit 252 is slidably mounted between the material 150 and the other end of the plate 258. The cutting unit 252 is able to be moved toward and away from the material 150. The cutting elements 254 can be all at the same height and have the same length or can be at different heights with different lengths. In addition, the height and length of the cutting elements 254 could be adjusted such as by the controller 260 to vary the depth and location of the cut. The cutting elements 254 can be heated wires or knives or blades such as discussed above. Preferably, the controller 260 in the form of a computer designs the three-dimensional structure, encodes the three-dimensional coordinates, transmits these coordinates to the apparatus 250 attached to the computer, controls the temperature of the cutting elements 254, and controls the position of the cutting unit 252 and the material 150 relative to each other. Controlled movements of the cutting unit 252 and/or the material 150 in x, y and z results in the spatially specific removal of material 150 by the cutting elements 254. Movement of the cutting unit 252 and the material 150 can also be manually controlled.

To use the three-dimensional cutting apparatus 250, a block of material 150 is placed in the mounting bracket 256. In the preferred embodiment, the block of material 150 is in the form of a cylinder (FIG. 15). The controller 260 is then programmed with the correct information to produce the desired three-dimensional object. To create the three-dimensional object, the cutting unit 252 slides back and forth toward and away from the material 150 while the material 150 is rotated as necessary to produce the three-dimensional object. The depth and height of the cutting elements 254 can be varied by the controller 260 as necessary to produce the three-dimensional object.

Figure 16:
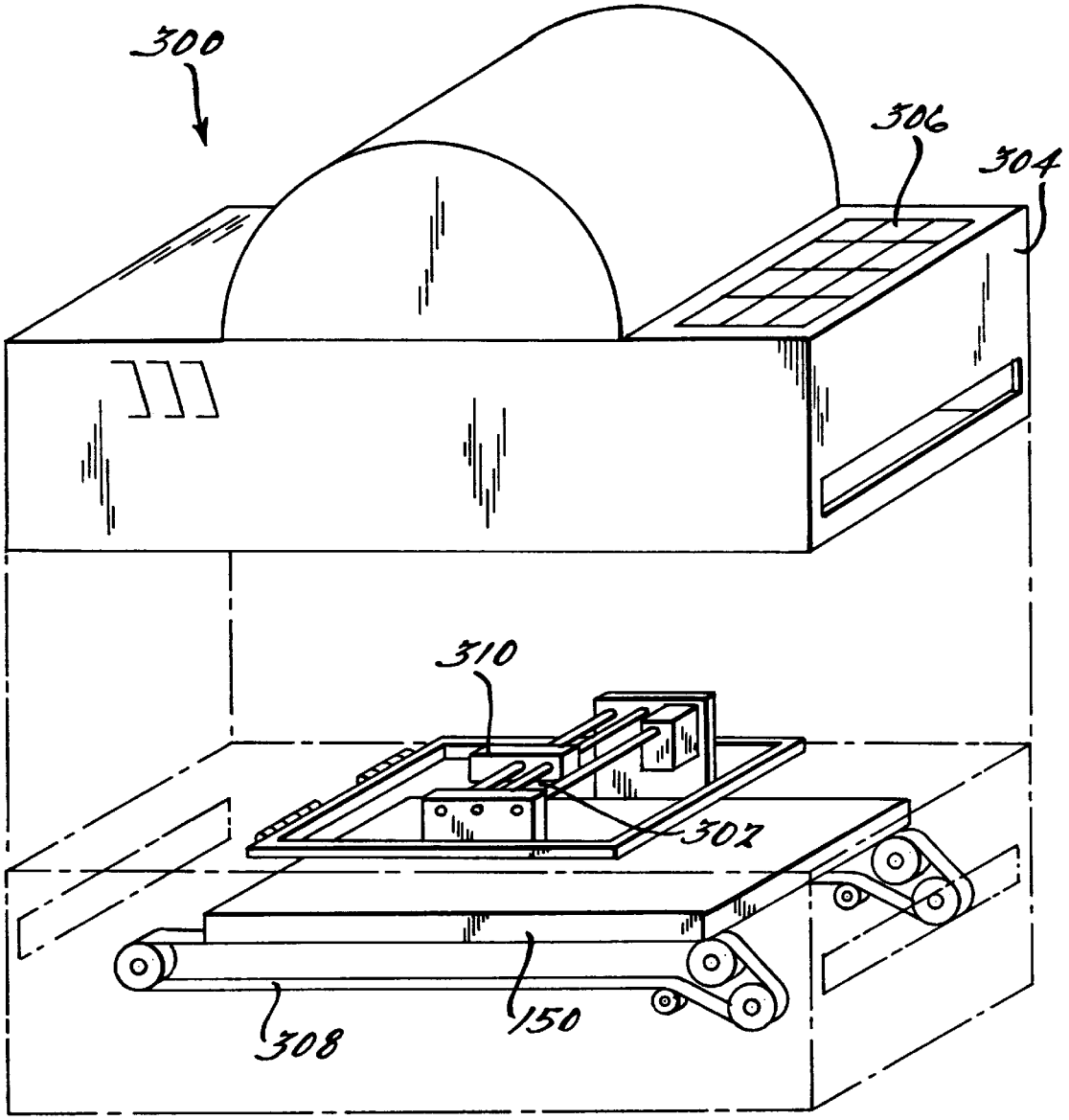
FIG. 16 is a perspective schematic view of the automated cutter apparatus 300 showing the cutting unit 310, the conveyor 308, the control circuit 306 and the cutting element 302.

In another embodiment, an apparatus 300 similar to an ink jet is used to produce an image before or after the preform material 150 is cut (FIG. 16). The apparatus 300 is provided with input from a computer (not shown) as necessary to produce a certain object. The cutting element 302 moves along the material 150 imprinting and cutting the material 150 in response to input from the computer to produce the desired two-dimensional object. The apparatus 300 includes a housing 304 within which is included the controller 306 for controlling the cutting unit 310 and a conveyor 308 for moving the material 150 into and out of the apparatus 300. The cutting unit 310 is preferably similar to that used in the drawing apparatus 10. The cutting unit 310 could also be replaced with an actual ink jet mechanism and pens which would allow pictures to be drawn on a material 150.

The apparatus 10 of the present invention can have a physical element which is moved in contact with the preform material 150 to produce the shaped object. This includes various sharp objects which can be made to vibrate for cutting. The support means for the apparatus 10 can have an array of heating elements and the preform material 150 can be moved through the cutter means on a conveyor 208 or can be rotated on a support means. The controller 24 can be a computer which is controlled by remote means which transmits a signal to the apparatus 10. All of these variations are encompassed within the scope of the present invention.

It is intended that the foregoing description be only illustrative and that the present invention be limited only by the hereinafter appended claims.

We claim:

1. An apparatus for cutting and sculpting a preform material to produce a shaped article, which comprises:

(a) a housing means having a length and a width with a top wall and an opposed bottom wall and at least one sidewall extending therebetween forming an inner chamber into which the perform material is inserted;

(b) a transverse arm means mounted on the housing spaced apart from the inner chamber so as to be moveable along the length of the housing;

(c) a pointer means moveable across the transverse arm means between the width of the housing and adjacent an outside surface of the top wall of the housing means and opposite the bottom wall of the housing means and spaced apart from the inner chamber;

(d) a cutter means mounted between the top wall and the bottom wall of the housing in the inner chamber of the housing which moves in response to movement of the pointer means to cut the preform material located in the inner chamber of the housing to form the shaped article; and (e) support means for the preform material in the inner chamber of the housing, whereby the preform material is cut by the cutting means to provide the shaped article as the pointer means and transverse arm means are moved.

2. The apparatus of claim 1 wherein the cutter means is a physical element which is moved in contact with the preform material to produce the cut.

3. The apparatus of claim 2 wherein the cutter means is a sharp object.

4. The apparatus of claim 2 wherein the cutter means is a heated element.

5. The apparatus of claim 1 wherein the cutter means vibrates to cut the preform material.

6. The apparatus of claim 1 wherein the support means is removable from the housing for inserting the preform material in and removing the shaped article from the housing.

7. The apparatus of claim 1 wherein a mechanical linkage is connected between the cutter means and the pointer means.

8. The apparatus of claim 1 wherein the transverse arm means and the pointer means are moved manually.

9. The apparatus of claim 1 wherein the pointer means and cutter means are controlled by a computer.

10. The apparatus of any one of claims 1 or 6 wherein the housing has an opening for mounting a templating means in the housing means.

* * * * *